US011632982B2

(12) United States Patent
Yoshimura et al.

(10) Patent No.: US 11,632,982 B2
(45) Date of Patent: Apr. 25, 2023

(54) PAPER FOR SMOKING ARTICLE AND SMOKING ARTICLE

(71) Applicant: JAPAN TOBACCO INC., Tokyo (JP)

(72) Inventors: Tetsuya Yoshimura, Tokyo (JP); Masato Miyauchi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 279 days.

(21) Appl. No.: 16/588,570

(22) Filed: Sep. 30, 2019

(65) Prior Publication Data

US 2020/0022404 A1 Jan. 23, 2020

Related U.S. Application Data

(63) Continuation of application No. PCT/JP2017/013399, filed on Mar. 30, 2017.

(51) Int. Cl.

| | |
|---|---|
| ***A24D 1/02*** | (2006.01) |
| ***A24D 3/10*** | (2006.01) |
| ***A24D 3/16*** | (2006.01) |
| ***D21H 27/00*** | (2006.01) |
| ***D21H 15/02*** | (2006.01) |
| ***D21H 17/67*** | (2006.01) |

(52) U.S. Cl.

CPC ..... *A24D 1/02* (2013.01); *A24D 3/10* (2013.01); *A24D 3/16* (2013.01); *D21H 15/02* (2013.01); *D21H 17/675* (2013.01); *D21H 27/00* (2013.01)

(58) Field of Classification Search

None

See application file for complete search history.

(56) References Cited

U.S. PATENT DOCUMENTS

| | | | | |
|---|---|---|---|---|
| 3,768,489 | A * | 10/1973 | Kiefer | A24D 3/04 131/340 |
| 5,263,500 | A * | 11/1993 | Baldwin | A24D 1/02 131/365 |
| 5,730,840 | A * | 3/1998 | Hampl, Jr. | A24D 1/02 131/365 |
| 6,823,872 | B2 * | 11/2004 | Hampl, Jr. | A24D 1/02 131/365 |
| 2002/0062834 | A1 | 5/2002 | Snaidr et al. | |
| 2005/0000531 | A1 * | 1/2005 | Shi | A24B 15/283 131/347 |
| 2005/0051185 | A1 | 3/2005 | Rasouli et al. | |

(Continued)

FOREIGN PATENT DOCUMENTS

| | | | |
|---|---|---|---|
| JP | H09-316792 | A | 12/1997 |
| JP | 2004-508470 | A | 3/2004 |

(Continued)

OTHER PUBLICATIONS

Extended European Search Report for European Application No. 17903532.4, dated Aug. 17, 2020.

(Continued)

*Primary Examiner* — Dennis R Cordray

(74) *Attorney, Agent, or Firm* — Birch, Stewart, Kolasch & Birch, LLP

(57) ABSTRACT

A paper for smoking articles containing cellulose fibers, and being made by adding cellulose nanofibers and filler particles serving as an absorbent or a catalyst, wherein primary particles of the filler particles have an average particle diameter of 1 μm or less.

9 Claims, 1 Drawing Sheet

(56) References Cited

U.S. PATENT DOCUMENTS

| | | | | |
|---|---|---|---|---|
| 2007/0095358 | A1 | 5/2007 | Li et al. | |
| 2011/0290436 | A1 | 12/2011 | Dumas et al. | |
| 2013/0247925 | A1 | 9/2013 | Ishikawa et al. | |
| 2014/0305455 | A1* | 10/2014 | Crooks | A24D 3/061 131/332 |
| 2016/0273165 | A1* | 9/2016 | Laine | D21H 21/18 |

FOREIGN PATENT DOCUMENTS

| | | | |
|---|---|---|---|
| JP | 2006-526996 | A | 11/2006 |
| JP | 2011-074529 | A | 4/2011 |
| JP | 2016-106182 | A | 6/2016 |
| TW | 201508128 | A1 | 3/2015 |
| WO | WO 2012/133797 | A1 | 10/2012 |
| WO | WO 2014/148207 | A1 | 9/2014 |
| WO | WO 2015/108078 | A1 | 7/2015 |

OTHER PUBLICATIONS

Taiwanese Office Action and Search Report for Taiwanese Application No. 106111085, dated Jun. 1, 2020, with English translation.
International Search Report for PCT/JP2017/013399 (PCT/ISA/210) dated Jun. 20, 2017, with English translation.

* cited by examiner

PAPER FOR SMOKING ARTICLE AND SMOKING ARTICLE

CROSS-REFERENCE TO RELATED APPLICATIONS

This application is a Continuation Application of PCT Application No. PCT/JP2017/013399 filed Mar. 30, 2017, the entire contents of which are incorporated herein by reference.

BACKGROUND OF THE INVENTION

1. Field of the Invention

The present invention relates to a paper for smoking articles and a smoking article.

2. Description of the Related Art

Smoking article, for example, filtered cigarette includes a cigarette rod formed by winding shredded tobacco by a wrapping paper and a filter formed by winding filter member by a filter wrapping paper. For example, the cigarette has a structure in which a cigarette rod and a filter are abutted, and the outer peripheral surface of the cigarette rod near the abutting portion and the outer peripheral surface of the filter are wound and joined by a tipping paper.

When smoking a smoking article, there is a possibility that mainstream smoke inhaled by the user contains unnecessary chemical components such as carbon monoxide, lower aldehyde represented by formaldehyde, nitrogen oxide, and tar. In order to remove these chemical components, it is common to include filler particles such as an absorbent or a catalyst in a filter member or a paper for smoking articles such as a wrapping paper.

Patent Literature 1 (WO 2012/133797 A1) discloses a smoking article including metal oxide or carbonate to reduce visible sidestream smoke and to produce modified ash at the same time.

BRIEF SUMMARY OF THE INVENTION

Generally, in an absorbent and a catalyst, as the average particle diameter of primary particles becomes smaller, a specific surface area becomes larger, and the effects of absorption and decomposition increases. Therefore, in an absorbent or a catalyst that are added to the paper for smoking articles such as a wrapping paper, it is desirable to use filler particles having a smaller average particle diameter to effectively remove the unnecessary chemical components in the mainstream smoke such as carbon monoxide, lower aldehyde represented by formaldehyde, nitrogen oxide, and tar.

However, when filler particles primary particle of which has a small average particle diameter are used in a conventional paper for smoking articles such as a wrapping paper, there has been a problem that filler particles easily fall off in the manufacturing process of the paper.

An object of the present embodiment is to provide a paper for smoking articles which can remove unnecessary chemical components in the mainstream smoke, prevent from falling off of filler particles in the manufacturing process, and improve the yield.

According to an present embodiment, provided is a paper for smoking articles containing cellulose fibers, and being made by adding cellulose nanofibers and filler particles serving as an absorbent or a catalyst, wherein primary particles of the filler particles have an average particle diameter of 1 μm or less.

According to a paper for smoking articles of the present embodiment, unnecessary chemical components in the mainstream smoke can be removed, falling off of filler particles in the manufacturing process can be prevented, and the yield can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
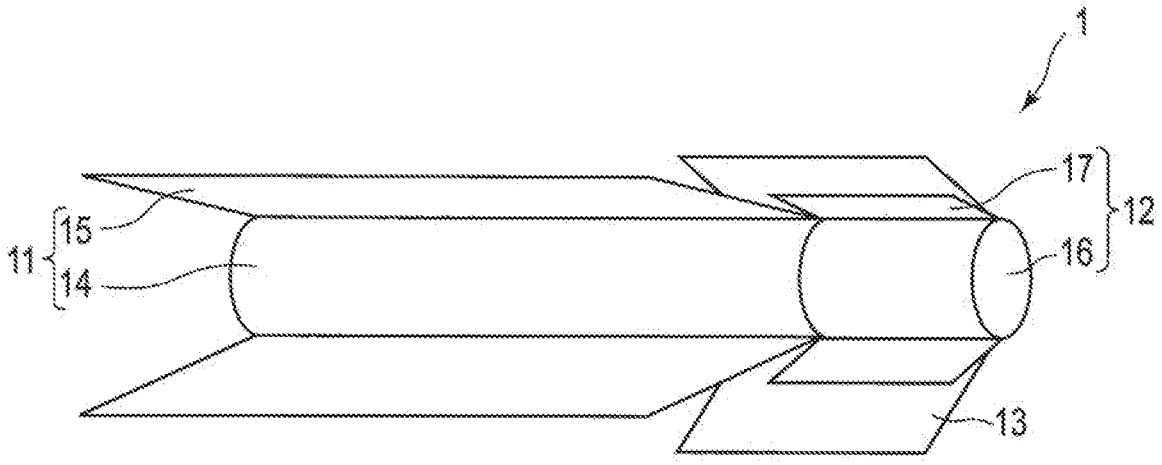
FIG. 1 is a perspective view illustrating a smoking article including a paper for smoking articles.

Hereinafter, a paper for smoking articles according to an embodiment will be described in detail.

The paper for smoking articles according to the present embodiment includes a cellulose fibers, and being made by adding a cellulose nanofibers and a filler particles serving as an absorbent or a catalyst, primary particles of which have an average particle diameter of 1 μm or less.

Generally, a paper can be made by sheeting wet paper in which cellulose fibers are suspended and drying the sheeted wet paper. In the wet paper, cellulose fibers form soft hydrogen bonding therebetween via water molecules, and when the drying process proceeds, the cellulose fibers become closer each other. As a result, in the dried paper, the cellulose fibers are bonded together by direct hydrogen bonding.

On the other hand, if the paper is made with filler particles added to the wet paper, the filler particles inhibit formation of the hydrogen bonding between the cellulose fibers. As a result, in the paper made with filler particles added, direct bonding between the cellulose fibers is weakened and gaps between the cellulose fibers are increased as compared to the paper made without adding filler particles. Thus, in the paper made with filler particles added thereto, filler particles tend to easily fall off in the manufacturing process, the tensile strength tends to decrease, and the air permeability tends to increase. However, in a paper for smoking articles such as a wrapping paper, the air permeability and the tensile strength are required to be within an appropriate range in order to have strength and handle ability required in the cigarette manufacturing process without impairing the flavor. Therefore, in the paper made with the filler particles added thereto, it is required to suppress the increase of the air permeability and the decrease of the tensile strength. The problems become more pronounced as primary particles of the filter particles added in the manufacturing has smaller average particle diameter, and as the amount of the filler particles is larger.

Furthermore, an binding agent such as a polysaccharide thickener may be added to the wet paper in order to prevent falling off of filler particles; however, it is not preferable because the binding agent tends to coat the surface of the filler particles to reduce the effect as the absorbent or the catalyst.

In the paper for smoking articles according to the present embodiment, the paper is made by further adding cellulose nanofibers to the wet paper in addition to the filler particles. In the paper, the cellulose nanofibers are bonded together by the hydrogen bonding so as to bridge between the cellulose fibers, and thus, the hydrogen bonding between the cellulose fibers can be reinforced. Thus, in the paper made with the filler particles and the cellulose nanofibers added thereto, the decrease of the tensile strength of the paper can be suppressed as compared to the paper made with only filler particles added thereto. Furthermore, with the presence of the cellulose nanofibers, gaps between the cellulose fibers can be reduced, and the increase of the air permeability of the paper can be suppressed, and that is, falling off of the filer particles in the manufacturing process does not easily occur, and the yield can be improved. Note that the cellulose nanofibers do not coat the surface of the filler particles, the effect of the filler particles as the absorbent or the catalyst is not prevented. That is, the paper for smoking articles according to the present embodiment is a mixture paper of the cellulose fibers and the cellulose nanofibers wherein the filler particles are held inside thereof.

According to the paper for smoking articles of the present embodiment, even if filler particles having a small average particle diameter are used, falling off of the filler particles in the manufacturing process can be suppressed. Therefore, in the paper for smoking articles according to the present embodiment, as compared to a conventional paper for smoking articles, it is possible to add more filler particles having smaller average particle diameter in the paper making. As a result, according to the paper for smoking articles of the present embodiment, unnecessary chemical components in the mainstream smoke, such as carbon monoxide, lower aldehyde represented by formaldehyde, nitrogen oxide, and tar, can be removed more efficiently. Furthermore, since the increase of the air permeability and the decrease of the tensile strength can be suppressed, and these parameters can be adjusted based on the physical property required for the paper for smoking articles.

Hereinafter, the cellulose fibers, cellulose nanofibers, and filler particles will be described in detail.

1) Cellulose Fibers

The cellulose fibers are not limited specifically, and for example, wood pulp fibers such as softwood pulp fibers or hardwood pulp fibers, flax pulp fibers, hemp pulp fibers, or sisal hemp pulp fibers used in a wrapping paper of ordinary smoking articles, or a mixture of the above fibers can be used. In the paper for smoking articles, the cellulose fibers are, for example, preferably contained by 10 gsm to 40 gsm in order to secure the air permeability and suppress the decrease of the tensile strength. As the cellulose fibers, for example, flax pulp fibers having a volume average fiber length of 1478 μm beaten so that the Schopper-Riegler freeness is 60° SR is used.

2) Cellulose Nanofibers

The cellulose nanofibers have an average fiber diameter D of 1 μm or less and a fiber length L satisfying L/D>100. The average fiber diameter of the cellulose nanofibers is, for example, 5 nm to 500 nm, and more preferably, 5 nm to 50 nm. The viscosity of the cellulose nanofibers in 2% by weight aqueous solution is, for example, 500 mPas to 8000 mPas, and preferably, 1000 mPas or more, and more preferably 6000 mPas to 8000 mPas. Since the viscosity of aqueous solution of cellulose nanofibers increase as the average fiber length of the cellulose nanofibers becomes longer, the viscosity can be used as an indication of the average fiber length of the cellulose nanofibers. The viscosity is a value measured by a rotation viscosity measurement method at 25° C. and a rotation speed of 60 rpm. As an example of the cellulose nanofibers, there is BiNFi-s (registered trademark) which is a biomass nanofiber producted by Sugino Machine Limited.

The manufacturing method of the cellulose nanofibers is not limited specifically, and any manufacturing method known to a person having ordinary skill in the art can be used. Examples of methods for producing long-fiber cellulose nanofibers include a polymer inter-array fiber method, peeling-type composite spinning method, improved conventional spinning method, superdrawing method, and laser drawing method. Examples of methods for producing short-fiber cellulose nanofibers include a melt flow method (jet spinning method), flash spinning method, beating method, mixture spinning method, tack spinning method, foam sheeting method, bacteriologic method, metal core hydrocarbon high temperature heating method, mold method, and electrospinning method.

Whether or not the paper for smoking articles is made by adding cellulose nanofibers can be determined, for example, by analyzing the paper for smoking articles using a scanning electron microscope (SEM).

3) Filler Particles

The filler particles serve as a catalyst or an absorbent to decompose or absorb unnecessary chemical components contained in the mainstream smoke. As a catalyst, for example, a metal oxide or a metal hydroxide can be used and as a metal oxide or a metal hydroxide, an oxide or a hydroxide of at least one metal element selected from a group consisting of B, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt, and Au can be used. As an absorbent, for example, porous materials, ion exchange resins, or clay minerals can be used, and more preferably, the absorbent will be selected from a group consisting of an activated carbon, silica, alumina, titania, aluminosilicate, zeolite, mesoporous silica, hydrotalcite, sepiolite, or a combination of the above materials.

Hydrotalcite compounds have a structure in which layered crystals are laminated, and can be represented by the following general formula: $M^{2+}_{1-x}M^{3+}_{x}(OH)_2(A^{n-})_{x/n}\cdot mH_2O$ (wherein $M^{2+}$ is a divalent metal ion selected from a group consisting of Mg, Zn, Ni, and Ca, $M^{3+}$ is Al ion, $A^{n-}$ is n-valent anion selected from a group consisting of $CO_3$, $SO_4$, OOC—COO, Cl, Br, F, $NO_3$, $Fe(CN)_6^{3-}$, $Fe(CN)_6^{4-}$, phthalic acid, isophthalic acid, terephthalic acid, maleic acid, alkenyl acid, and their derivatives, and malic acid, salicylic acid, acrylic acid, adipic acid, succinic acid, citric acid, and sulfonic acid, and $0.1<x<0.4$, $0<m<2$).

Primary particles of the filler particles have an average particle diameter(median diameter ($d_{50}$)) of 1 μm or less, and preferably, 10 nm to 500 nm, and more preferably, 10 nm to 100 nm. If of the primary particles of the filler particles have smaller average particle diameter, the specific surface area of the filler particles increases, and thus, the effect of absorption or decomposition of unnecessary chemical components in the mainstream smoke by the filler particles can be improved, which is desirable. On the other hand, if of the primary particles of the filler particles have the average particle diameter of less than 10 nm, scattering of the filler particles in the manufacturing process of the paper for smoking articles easily occur, which is not desirable. Note that a term "primary particle" means a particle determined as a unit particle from the exterior geometrical shape, and a term "secondary particle" means an aggregation of a great number of primary particles.

In the paper for smoking articles, the filler particles are, for example, preferably, contained by 2% by weight to 60% by weight, and more preferably, contained by 25% by weight to 35% by weight. If the basis weight of the filler particles is less than 2% by weight, although it depends on the type of filler particles, the effect of absorption or decomposition of unnecessary chemical components in the mainstream smoke by the filler particles tends to decrease, which is not desirable. If the amount of filler particles exceeds 60% by weight, the tensile strength of the paper for smoking articles decreases, and the air permeability increases, so that the physical properties tend to be unsuitable as the paper for smoking articles, which is not desirable. Furthermore, in the paper for smoking articles, the filler particles are, preferably, contained by 2 gsm to 40 gsm, for example, and more preferably, contained by 10 gsm to 40 gsm in the paper.

The air permeability of the paper for smoking articles is, for example, 10 CORESTA units to 500 CORESTA units, and more preferably, 10 CORESTA units to 100 CORESTA units. In the present specification, the air permeability represents a flow rate of gas passing through an area of 1 $cm^2$ when a differential pressure in both surfaces of a paper is 100 $mmH_2O$ by a unit of $ml \cdot cm^2/min$. 1 $ml \cdot cm^2/min$ is 1 CORESTA unit (1 C.U.). If the air permeability of the paper for smoking articles is less than 10 CORESTA units, the mainstream smoke is difficult to come into contact with the filler particles added to the paper for smoking articles, which is not desirable. If the air permeability of the paper for smoking articles exceeds 500 CORESTA units, when the paper for smoking articles is used as a wrapping paper, the burning rate of the cigarette rod becomes too fast, which is not desirable.

The tensile strength of the paper for smoking articles is, preferably, 12.5 N/15 mm or more, for example. If the tensile strength of the paper for smoking articles is less than 12.5 N/15 mm, when the paper for smoking articles is used as a wrapping paper or a filter wrapping paper, there is a possibility that the paper may not endure the machine speed of a winding machine and break. The basis weight of the paper for smoking articles is, for example, preferably, 15 gsm to 100 gsm, and more preferably, 20 gsm to 80 gsm, and further more preferably, 40 gsm to 60 gsm. If the basis weight of the paper for smoking articles is within the above ranges, when the paper for smoking articles is used as a wrapping paper or a filter wrapping paper, the paper can be winding without easily breaking and to fit the shape of the shredded tobacco or the filter member, which is desirable.

Note that the paper for smoking articles may contain various additives such as a flavor agent, a combustion adjustment agent, and coloring agent other than the cellulose fibers, the cellulose nanofibers and the filler particles.

The paper making method of the paper for smoking articles is not limited specifically, and it can be produced by the paper making method known to a person having ordinary skill in the art. A paper making method generally includes a paper sheeting process and a paper drying process. As a paper making machine, a conventionally known machine such as cylinder paper machine, inclined tanmo machine, fourdrinier paper machine, or tanmo machine can be used, and the paper machines may be combined depending on required properties. A wet sample used in the paper sheeting process is, for example, prepared by adding a certain amount of filler particles and cellulose nanofibers to a slurry prepared by beating cellulose fibers so that the Schopper-Riegler freeness becomes 60° SR. The sheeted wet paper can be dried by a conventionally known drying method using, for example, a yankee dryer type, multi-cylinder type, heat wind type, infrared heating type, or the like. The wet paper can be dried in a temperature of 100° C. to 150° C., for example.

Note that the paper for smoking articles is made by adding cellulose nanofibers of, preferably, 2% by weight to 32% by weight, or more preferably, 4% by weight to 13% by weight, based on the total weight of the cellulose fibers, cellulose nanofibers, and filler particles. When the additive amount of the cellulose nanofibers in the paper making is within the above ranges, falling off of the filler particles in the manufacturing process can be effectively suppressed.

The above-described paper for smoking articles can achieve the effects when being used as various papers constituting the smoking articles as shown in FIG. 1. Here, although a filtered cigarette will described as an example of a smoking article; however, the smoking article may be configured without a filter. The smoking article may be another smoking article, for example, a cigar, a cigarillo, or the like. If the smoking article is a cigar, a cigarillo, or the like, the filler may be configured either before or after wrapping, the article with a binder.

A filtered cigarette 1 is shown in FIG. 1, as an example of the smoking article provided with the paper for smoking articles according to the present embodiment. The filtered cigarette 1 includes a cigarette rod 11, a filter 12 deposed so that an end of which is abutted with an end of the cigarette rod 11, and a tipping paper 13 wound around the entire outer peripheral surface of the filter 12 and the part of the outer peripheral surface of the cigarette rod 11 near the abutting portion to combine the cigarette rod 11 and the filter 12. The cigarette rod 11 includes shredded tobacco 14 and a wrapping paper 15 winding the shredded tobacco 14 in a cylindrical shape. The filter 12 includes, for example, a filter member 16 formed by making acetate tow, paper, pulp non-woven fabric, or the like into a tow structure which is a bundle of monofilaments, or folding or compressing the same, and a filter wrapping paper 17 winding the filter member 16 in a cylindrical shape.

The paper for smoking articles is, for example, used as the wrapping paper 15 as in FIG. 1. When the smoking article 1 is smoked by a user, the mainstream smoke from the cigarette rod 11 passes through the inside of the shredded tobacco 14 and the wrapping paper 15, and then, passes through the filter 12 to be discharged from the downstream end thereof. At that time, unnecessary chemical components contained in the mainstream smoke (for example, carbon monoxide and the like) are absorbed or decomposed by the filler particles added to the wrapping paper. As a result, the unnecessary chemical components contained in the mainstream smoke inhaled by the user can be reduced. When the paper for smoking articles is used as a wrapping paper, it is more preferable that the tensile strength thereof is 12.5 N/mm or more, and the air permeability thereof is 10 CORESTA units to 100 CORESTA units.

The paper for smoking articles is, for example, used as the filter wrapping paper 17 as in FIG. 1. When the smoking article 1 is smoked by a user, the mainstream smoke from the cigarette rod 11 passes through the inside of the filter wrapping paper 17 while passing through the filter 12 to be discharged from the downstream end thereof. With this configuration, it is possible to obtain the same effect as when the paper for smoking articles is used as the wrapping paper 15.

Figure 2:
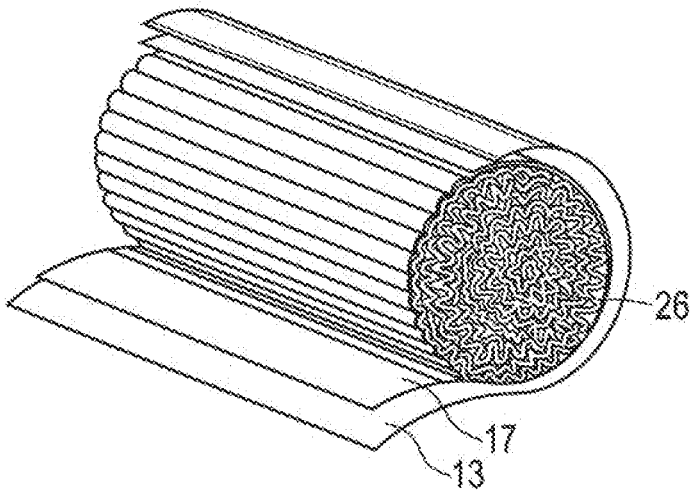
FIG. 2 is a perspective view illustrating a filter member using the paper for smoking articles.

The paper for smoking articles is, for example, used as the filter member 16 as in FIG. 1. The paper for smoking articles is, for example, used as a filter member obtained by forming the paper for smoking articles cut into a strip shape into a filter shape, or as a filter member 26 having a folded structure obtained by creping the paper for smoking articles as in FIG. 2. When the smoking article 1 is smoked by a user, the mainstream smoke from the cigarette rod 11 passes through the inside of the filter member 16 while passing through the filter 12 to be discharged from the downstream end thereof. With this configuration, it is possible to the same effect as when the paper for smoking articles is used as the wrapping paper 15.

Note that the paper for smoking articles may be used as a paper for smoking articles other than the above wrapping paper 15, filter wrapping paper 17, and filter member 16. Furthermore, in the smoking article, the paper for smoking articles may be used as any one or more of the wrapping paper, filter wrapping paper, and filter member.

EXAMPLES AND COMPARATIVE EXAMPLES

Hereinafter, the present embodiment will be described in more detail with reference to examples 1 to 16 and comparative examples 1 to 6. Test samples according to examples 1 to 16 and comparative examples 1 to 6 were prepared by the following methods.

Examples 1 and 2

As the filler particles, hydrotalcite ($Mg_6Al_2(OH)_{16}CO_3.4H_2O$) the primary particles of which have an average particle diameter of 50 nm and which have a BET surface area of 111.5 $m^2/g$ was used. As the cellulose nanofibers, biomass nanofiber produced by Sugino Machine Limited: BiNFi-s (registered trademark), type FMa-10002. Note that BiNFi-s (registered trademark), type FMa-10002 is cellulose nanofiber with a short average fiber length having an average fiber diameter of approximately 20 nm, and the viscosity in 2% by weight aqueous solution of 700 mPas.

Slurries were prepared by beating cellulose fibers, which are the flax pulp fibers, so that a slurry exerts Schopper-Riegler freeness of 60° SR with the additive amount shown in Table 1 below. Then, the filler particles and the cellulose nanofibers were added to the beaten flax pulp fibers with the additive amount shown in Table 1 below. Then, using the obtained wet paper base, the wet paper was sheeted by a TAPPI standard hand paper machine. Then, the wet paper was dried for approximately one minute at 100° C. with a KRK rotational drier of Kumagai Riki Kogyo Co., Ltd., and then dried for twelve hours at 105° C. with a hot air circulation drier (produced by Koyo Thermo Systems Co., Ltd., KLO-60M (product name)). Then, the samples was placed under a condition where a temperature is 22° C. and a relative humidity is 60%, and was cut into a certain length, and prepared test samples of examples 1 and 2.

Examples 3 and 4

In examples 3 and 4, the test samples were prepared with the additive amounts of Table 1 below in a similar manner as in examples 1 and 2 except that cellulose nanofibers different from those in examples 1 and 2 were used. The cellulose nanofibers used were biomass nanofiber produced by Sugino Machine Limited: BiNFi-s (registered trademark), type IMa-10002. Note that BiNFi-s (registered trademark), type IMa-10002 is cellulose nanofiber with a long average fiber length having an average fiber diameter of approximately 20 nm and the viscosity in 2% by weight aqueous solution of 7500 mPa·s.

Comparative Example 1

In comparative example 1, the test sample was prepared in a similar manner as in examples 1 and 2 with the additive amounts of Table 1 below except that the paper was made without adding cellulose nanofibers. That is, the test sample of comparative example 1 was a paper made from cellulose fibers that is flax pulp fibers and filler particles that are hydrotalcite.

Comparative Example 2

In comparative example 2, the test sample was prepared in a similar manner as in examples 1 and 2 except that the paper was made without adding cellulose nanofibers and filler particles. That is, the test sample according to comparative example 2 was made from only cellulose fibers that is flex pulp fibers.

Examples 5, 6, 9, 10, 13, and 14

In examples 5, 6, 9, 10, 13, and 14, the test samples were prepared in a similar manner as in examples 1 and 2 except for the additive amounts of hydrotalcite, with the additive amounts of Tables 2, 3, and 4 below, respectively.

Examples 7, 8, 11, 12, 15, and 16

In examples 7, 8, 11, 12, 15, and 16, the test samples were prepared in a similar manner as in examples 3 and 4 except for the additive amounts of hydrotalcite, with the additive amounts shown in Tables 2, 3, and 4 below, respectively.

Comparative Examples 3, 4, and 6

In comparative examples 3, 4, and 6, the test samples were prepared in a similar manner as in comparative example 1 except for an additive amount of hydrotalcite, with the additive amounts of Tables 2, 3, and 4 below, respectively.

Comparative Example 5

In comparative example 5, the test sample was prepared in similar manner as in comparative example 2 except for an additive amount of cellulose fibers, with the additive amount shown in Table 3.

Tables 1 to 4 show amounts of cellulose fibers, filler particles, and cellulose nanofibers added in the paper making, basis weight of the paper, and amount of filler particles contained in the paper, and furthermore, measurement results of (1) yield of filler particles, (2) air permeability, and (3) tensile strength with respect to the test samples of examples 1 to 16 and comparative examples 1 to 6. In examples 1 to 4 and comparative example 1 of Table 1, the amount of filler particles added in the paper making is 16 gsm. In examples 5 to 8 and comparative example 3 of Table 2, the amount of filler particles added in the paper making is 32 gsm. In examples 9 to 12 and comparative example 4 of Table 3, the amount of filler particles added in the paper making is 48 gsm. In examples 13 to 16 and comparative example 5 of Table 4, the amount of filler particles added in the paper making is 96 gsm. In comparative examples 2 of Tables 1 and 2 and comparative example 5 of Tables 3 and 4, a filler particles are not added in the paper making. Note that the amount of cellulose nanofibers added in the paper making [% by weight] shown in Tables 1 to 4 is % by weight of cellulose nanofibers based on the total weight of the cellulose fibers, cellulose nanofibers, and filler particles.

TABLE 1

| | Cellulose fibers amount added [gsm] | Filler particles amount added [gsm] | Cellulose nanofibers | Cellulose nanofibers amount added [gsm] | Cellulose nanofibers amount added [% by weight] | Paper weight [gsm] | Filler particles amount contained [gsm] | Filler particles amount contained [% by weight] | Filler particles yield [%] | Air permeability [C.U.] | Tensile strength [N/15 mm] |
|---|---|---|---|---|---|---|---|---|---|---|---|
| Example 1 | 27.04 | 16 | FMa-10002 | 1.6 | 3.58 | 40.2 | 11.52 | 28.7 | 72.0 | 120 | 19.4 |
| Example 2 | 27.04 | 16 | | 6.4 | 12.94 | 46.9 | 13.44 | 28.7 | 84.0 | 67 | 22.4 |
| Example 3 | 27.04 | 16 | IMa-10002 | 1.6 | 3.58 | 42.9 | 14.24 | 33.2 | 89.0 | 81 | 22.7 |
| Example 4 | 27.04 | 16 | | 6.4 | 12.94 | 48.2 | 14.72 | 30.6 | 92.0 | 55.7 | 24.8 |
| Comparative example 1 | 27.04 | 16 | — | — | — | 34.6 | 7.52 | 21.8 | 47.0 | 164 | 17.9 |
| Comparative example 2 | 27.04 | 0 | — | — | — | 25.3 | 0.00 | 0.0 | 0 | 17.3 | 24.3 |

TABLE 2

| | Cellulose fibers amount added [gsm] | Filler particles amount added [gsm] | Cellulose nanofibers | Cellulose nanofibers amount added [gsm] | Cellulose nanofibers amount added [% by weight] | Paper basis weight [gsm] | Filler particles amount contained [gsm] | Filler particles amount contained [% by weight] | Filler particles yield [%] | Air permeability [C.U.] | Tensile strength [N/15 mm] |
|---|---|---|---|---|---|---|---|---|---|---|---|
| Example 5 | 27.04 | 32 | FMa-10002 | 1.6 | 2.64 | 48.2 | 19.52 | 40.5 | 61.0 | 200 | 15.1 |
| Example 6 | 27.04 | 32 | | 6.4 | 9.78 | 53.6 | 20.16 | 37.6 | 63.0 | 110 | 19.6 |
| Example 7 | 27.04 | 32 | IMa-10002 | 1.6 | 2.64 | 51.2 | 22.56 | 44.1 | 70.5 | 163 | 17.2 |
| Example 8 | 27.04 | 32 | | 6.4 | 9.78 | 56.5 | 23.04 | 40.8 | 72.0 | 85 | 22.6 |
| Comparative example 3 | 27.04 | 32 | — | — | — | 37.1 | 10.08 | 27.2 | 31.5 | 271 | 15.5 |
| Comparative example 2 | 27.04 | 0 | — | — | — | 25.3 | 0.00 | 0.0 | 0 | 17.3 | 24.3 |

TABLE 3

| | Cellulose fibers amount added [gsm] | Filler particles amount added [gsm] | Cellulose nanofibers | Cellulose nanofibers amount added [gsm] | Cellulose nanofibers amount added [% by weight] | Paper basis weight [gsm] | Filler particles amount contained [gsm] | Filler particles amount contained [% by weight] | Filler particles yield [%] | Air permeability [C.U.] | Tensile strength [N/15 mm] |
|---|---|---|---|---|---|---|---|---|---|---|---|
| Example 9 | 28.16 | 48 | FMa-10002 | 1.6 | 2.06 | 51.0 | 21.28 | 41.7 | 44.3 | 344 | 11.2 |
| Example 10 | 28.16 | 48 | | 6.4 | 7.75 | 56.3 | 21.76 | 38.6 | 45.3 | 169 | 12.8 |
| Example 11 | 28.16 | 48 | IMa-10002 | 1.6 | 2.06 | 55.4 | 25.60 | 46.2 | 53.3 | 270 | 11.5 |
| Example 12 | 28.16 | 48 | | 6.4 | 7.75 | 60.9 | 26.35 | 43.3 | 54.9 | 123 | 14.9 |
| Comparative example 4 | 28.16 | 48 | — | — | — | 40.5 | 12.32 | 30.4 | 25.7 | 382 | 10.7 |
| Comparative example 5 | 28.16 | 0 | — | — | — | 26.4 | 0.00 | 0.0 | 0 | 17.3 | 24.3 |

TABLE 4

| | Cellulose fibers amount added [gsm] | Filler particles amount added [gsm] | Cellulose nanofibers | Cellulose nanofibers amount added [gsm] | Cellulose nanofibers amount added [% by weight] | Paper basis weight [gsm] | Filler particles amount contained [gsm] | Filler particles amount contained [% by weight] | Filler particles yield [%] | Air permeability [C.U.] | Tensile strength [N/15 mm] |
|---|---|---|---|---|---|---|---|---|---|---|---|
| Example 13 | 28.16 | 96 | FMa-10002 | 1.6 | 1.27 | 63.4 | 33.60 | 53.0 | 35.0 | 500 or more | 8.6 |
| Example 14 | 28.16 | 96 | | 6.4 | 4.90 | 68.5 | 33.92 | 49.5 | 35.3 | 268 | 9.9 |
| Example 15 | 28.16 | 96 | IMa-10002 | 1.6 | 1.27 | 68.2 | 38.40 | 56.3 | 40.0 | 323 | 10.2 |

TABLE 4-continued

| | Cellulose fibers amount added [gsm] | Filler particles amount added [gsm] | Cellulose nanofibers | Cellulose nanofibers amount added [gsm] | Cellulose nanofibers amount added [% by weight] | Paper basis weight [gsm] | Filler particles amount contained [gsm] | Filler particles amount contained [% by weight] | Filler particles yield [%] | Air permeability [C.U.] | Tensile strength [N/15 mm] |
|---|---|---|---|---|---|---|---|---|---|---|---|
| Example 16 | 28.16 | 96 | | 6.4 | 4.90 | 73.9 | 39.36 | 53.2 | 41.0 | 140 | 14.1 |
| Comparative example 6 | 28.16 | 96 | — | — | — | 47.5 | 19.36 | 40.7 | 20.2 | 500 or more | 8.5 |
| Comparative example 5 | 28.16 | 0 | — | — | — | 26.4 | 0.00 | 0.0 | 0 | 17.3 | 24.3 |

The measurement method of each test (1) to (3) will be described below.

(1) Yield of Filler Particles

The yield of filler particles was measured using a hot air circulation drier (manufactured by Koyo Thermo Systems Co., Ltd., KLO-60M (product name)). Initially, each test sample was placed in the hot air circulation drier set to 105° C. and dried for twelve hours, and then, a dry weight of the paper was measured. Then, the amount of cellulose fibers and cellulose nanofibers added in the paper making process was subtracted from the dry weight of the paper to calculate the content of filler particles contained in the paper. The yield can be calculated from the following formula.

Yield (%)=Amount of contained filler particles/amount of filler particles added in paper making process×100

(2) Air Permeability

Air permeability was measured with air permeability measurement device (manufactured by Borfwaldt, Air Permeability Tester A20 (product name)) based on the method described in Coresta method No. 3. Air permeability is a flow of gas passing through an area of 1 $cm^2$ when a differential pressure in both surfaces of a paper is 100 $mmH_2O$ using a unit of $ml \cdot cm^2/min$. 1 $ml \cdot cm^2/min$ is 1 CORESTA unit (1 C.U.).

(3) Tensile Strength

Tensile strength was measured using a tensile strength measurement device (manufactured by Toyo Seiki Co., Ltd., STRONGRAPH E3-L (product name)) based on JIS P 8113. Each test sample was cut to have a width of 15 mm and a length of 200 mm, and pulled at a tensile strength of 200 mm/min, and then, a load at the time of breaking was measured as a value of the tensile strength.

Results

The measurement results of test samples according to examples 1 to 16 and comparative examples 1 to 6 will be described.

With reference to Table 1, examples 1 to 4 in which filler particles and cellulose nanofibers were added to the cellulose fibers in the paper making process will be compared to comparative example 1 in which only filler particles were added. The yields of filler particles in examples 1 to 4 were 72% to 92% which are higher value than 47% in comparative example 1. Air permeability in examples 1 to 4 were 55.7 C.U. to 120 C.U. which were lower values than 164 C.U. in comparative example 1. Furthermore, the tensile strength of examples 1 to 4 were 19.4 N/15 mm to 24.8 N/15 mm which are higher values than 17.9 N/15 mm in comparative example 1. Furthermore, amounts of filler particles contained in examples 1 to 4 were 28.7% by weight to 33.2% by weight which are higher values than 21.8% by weight in comparative example 1. From the above results, in examples 1 to 4, it can be seen that the addition of cellulose nanofibers could improve yield of filler particles, decrease the air permeability, and increase the tensile strength as compared to comparative example 1. Furthermore, in examples 1 to 4, filler particles having smaller average particle diameter were more added in the paper making process as compared to comparative example 1, and thus, unnecessary chemical components such as carbon monoxide, lower aldehyde represented by formaldehyde, nitrogen oxide, and tar in the mainstream smoke can be removed more effectively. The same results could be observed in Tables 2 to 4 in which additive amounts of filler particles are different from that of Table 1.

In Table 1, example 1 in which the amount of cellulose nanofibers added in the paper making process was 3.58% by weight is compared to example 2 in which the amount of cellulose nanofibers added in the paper making process was 12.94% by weight. In example 2, because the amount of cellulose nanofibers added in the paper making process was greater, it is can be seen that yield of filler is improved, the air permeability is decreased, and the tensile strength is increased as compared to example 1. The same results could be observed in Tables 2 to 4 in which additive amounts of filler particles are different from Table 1.

In Table 1, example 1 in which cellulose nanofibers added in the paper making process were FMa-10002 is compared to example 3 in which cellulose nanofibers added in the paper making process were IMa-10002. From the results, it can be seen that IMa-10002 of which viscosity in 2% by weight aqueous solution was 7500 mPa·s used in example 3 is more effective improving yield, reducing the air permeability, and increasing the tensile strength as compared to FMa-10002 of which viscosity in 2% by weight aqueous solution was 700 mPas used in example 1. As with the results in Table 1, the same results were observed from Tables 2 to 4 in which amounts of filler particles added are different.

As described above, since the cellulose nanofibers are added to the paper for smoking articles according to the present embodiment, even filler particles primary particles of which has a smaller average particle diameter are contained, decrease of yield, decrease of tensile strength, and increase of air permeability can be suppressed. Furthermore, in the paper for smoking articles according to the present embodiment, since the paper is made by adding filler particles having smaller average particle diameter as compared to conventional filler particles and more filler particles can be contained, and thus unnecessary chemical components in the mainstream smoke can be removed more effectively.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper for smoking articles which is a mixture paper of cellulose fibers and cellulose nanofibers, and filler particles inside the mixture paper, wherein the filler particles serving serve as an absorbent or a catalyst and are contained in the paper for smoking articles in an amount of 2% by weight to 60% by weight, wherein primary particles of the filler particles having have an average particle diameter of 10 nm to 50 nm, and wherein the paper for smoking articles has an air permeability of 10 CORESTA units to 500 CORESTA units.

2. The paper for smoking articles of claim 1, wherein the paper for smoking articles has a basis weight of 20 gsm to 80 gsm.

3. The paper for smoking articles of claim 1, wherein the paper for smoking article is made by adding the cellulose nanofibers of 2% by weight to 32% by weight, based on the total weight of the cellulose fibers, the cellulose nanofibers, and the filler particles.

4. The paper for smoking articles of claim 1, wherein the paper for smoking article is made by adding the cellulose nanofibers of 4% by weight to 13% by weight, based on the total weight of the cellulose fibers, the cellulose nanofibers, and the filler particles.

5. The paper for smoking articles of claim 1, wherein the cellulose nanofibers have an average fiber diameter of 50 nm or less, and a viscosity in a 2% by weight aqueous solution of the cellulose nanofibers is 1000 mPas or more.

6. The paper for smoking articles of claim 1, wherein the paper for smoking articles has a tensile strength of 12.5 N/15 mm or more.

7. A smoking article comprising the paper for smoking articles of claim 1 as a wrapping paper wound around a shredded tobacco of cigarette.

8. A filtered smoking article comprising the paper for smoking articles of claim 1 as a filter wrapping paper wound around a filter member.

9. A filtered smoking article comprising the paper for smoking articles of claim 1 as a filter member.

* * * * *